US010365055B1

(12) United States Patent
Cross

(10) Patent No.: US 10,365,055 B1
(45) Date of Patent: Jul. 30, 2019

(54) MULTI MAGAZINE LOCKING BASE PLATE

(71) Applicant: Wes Cross, San Diego, CA (US)

(72) Inventor: Wes Cross, San Diego, CA (US)

( * ) Notice: Subject to any disclaimer, the term of this patent is extended or adjusted under 35 U.S.C. 154(b) by 0 days.

(21) Appl. No.: 16/178,407

(22) Filed: Nov. 1, 2018

Related U.S. Application Data

(60) Provisional application No. 62/620,013, filed on Jan. 22, 2018.

(51) Int. Cl.
*F41A 9/63* (2006.01)
*F41A 9/65* (2006.01)

(52) U.S. Cl.
CPC .. *F41A 9/63* (2013.01); *F41A 9/65* (2013.01)

(58) Field of Classification Search
CPC ..... F41A 9/63; F41A 9/65; F41A 9/68; F41A 9/61
USPC ..... 42/49.01
See application file for complete search history.

(56) References Cited

U.S. PATENT DOCUMENTS 3,191,332 A * 6/1965 Ardolino ..... F41A 9/63 42/50
3,623,256 A * 11/1971 Shiplee ..... F41A 9/63 42/50
4,447,976 A * 5/1984 Cooper ..... F41A 9/63 42/18
4,685,238 A * 8/1987 Schoepflin ..... F16B 5/0004 42/90
7,805,875 B1 * 10/2010 Obong ..... F41A 9/61 224/931
8,925,231 B2 * 1/2015 Lee ..... F41A 9/65 42/49.01
9,354,006 B2 * 5/2016 Purkiss ..... F41A 9/68
9,631,883 B2 * 4/2017 Grandy ..... F41A 9/63
10,126,076 B2 * 11/2018 Klein ..... F41A 9/63
10,240,893 B2 * 3/2019 Henderson ..... F41C 23/22
2016/0003567 A1 * 1/2016 Purkiss ..... F41A 9/68 42/49.01
2016/0033220 A1 * 2/2016 Grandy ..... F41A 9/63 42/49.01

* cited by examiner

*Primary Examiner* — Joshua E Freeman
(74) *Attorney, Agent, or Firm* — Eric Hanscom

(57) ABSTRACT

This disclosure describes a device that can removably restrain multiple magazines of bullets for a firearm. A preferred embodiment teaches a main body where the locking plate boss of a magazine can be locked and unlocked on either side of the main body; thereby allowing a user to "attach" two magazines of bullets to his/her firearm, and when one magazine is exhausted of bullets, merely pull that magazine out, flip it over, and insert the second magazine. Several means of locking and unlocking are contemplated, including having a removable drive shaft that can rotate a paddle, additionally providing a drive shaft with a wedge-shaped face, and additionally providing a shaft with a key built into it.

18 Claims, 6 Drawing Sheets

MULTI MAGAZINE LOCKING BASE PLATE

CROSS REFERENCE TO RELATED APPLICATIONS

This application claims priority to U.S. Provisional Application No. 62/620,013, entitled "Multi Magazine Locking Base Plate" with a filing date of 22 Jan. 2018.

STATEMENT REGARDING FEDERALLY SPONSORED RESEARCH OR DEVELOPMENT

This invention was not federally sponsored.

BACKGROUND OF THE INVENTION

The present invention is in the technical field of firearms. More particularly, the present invention is in the technical field of ammunition magazine base plates. More specifically, the present invention is in the field of ammunition magazine base plates that can attach and detach more than one magazine.

Since the inception of the guns, shooters have striven to improve the efficiency of re-loading. This was sensible for the hunter to avoid losing game, for the soldier to protect against his enemy, and for the farmer to defend his person and property. The revolver and repeating rifle improved upon the ball and black power by enabling the loading of multiple rounds, either in a rotating cylinder that could fire six bullets before re-loading was necessary, or into a captured enclosure in the rifle. The pistol improved upon the revolver by utilizing a magazine that can hold sometimes as many as 20 rounds, although 10 round magazines are by far the most common. For rifles one can find magazines that hold much larger numbers of rounds.

Today, many states have instituted laws that limit the maximum number of rounds in a magazine to ten, and in some cases less than ten. The present invention helps individuals in regulated states as well as in unregulated states by securely fixing two magazines together at the base of the magazine by means of the present invention. This doubles the amount of ammunition attached and carried in a weapon. For some individuals, including professional and amateur competitive shooters, individuals protecting their families and property, military and law enforcement, the number of rounds in a magazine, and magazine replacement speed, can be critical.

The present invention provides for the attachment of two magazines of any capacity to a single base plate. A typical magazine includes the magazine body, a follower, a spring, an insert or locking plate and a base plate. The locking plate mechanism fixes into the base plate to prevent the magazine from disassembling while in use. The locking mechanism on a typical base plate cannot be released without easy access to the bottom of the magazine. Because of this design it has not previously been possible to connect two magazines at the base plates. The present invention employs a locking mechanism that can be operated without requiring direct access to the bottom of the magazines, and allows a user of the invention to benefit from being able to use the bullets from two magazines in a manner significantly more efficient that having to find a second magazine and insert it.

OBJECTS OF THE INVENTION

It is an object of the present invention to provide a method for replacing the base plate of a typical single magazine with a base plate that can accommodate a magazine attached to one side of the base plate and a second magazine attached to the opposing side of the base plate. Additionally, the present invention will allow one to remove one or both magazines with relative ease, with the use of a commonly available tool.

The present embodiment is a magazine locking base plate comprising a main body, a drive shaft, a paddle and an internal retaining ring. The paddle is inserted into the paddle slot then the drive shaft is inserted into the shaft hole in the main body. The drive shaft passes through, and is retained, in the center of the paddle. The paddle and drive shaft are held in the main body by the retaining ring, where the retaining ring expands into a retaining ring groove in the main body to "lock" the paddle and drive shaft. The main body incorporates a base flange slot on both the top and bottom of the present embodiment that allow a magazine assembly to be inserted by sliding the base flange of a magazine body into the base flange slot on both sides of the main body. The magazine assembly is retained by its flange in the main body flange slot of the present embodiment. To lock a magazine to the present embodiment the drive shaft is rotated, releasing the locking plate of the magazine to engage the base plate With the present invention attached to a magazine assembly, the magazine assembly can be unlocked and the present embodiment removed by rotating the drive shaft in the opposite direction using a commonly available tool, thereby rotating the paddle and raising the locking plates free of the base plate, and allowing the magazines to be removed from the base flange in the main body.

The foregoing is a broad outline of the purpose, features and functions of the present invention in order (i) to facilitate a fuller understanding of the detailed description herein, and (ii) that the present contribution to the art may be better appreciated. There are additional features of the present invention that will be described below, and which will form the subject matter of the claims appended hereto. The features listed, as well as other features, aspects and advantages of the present invention may be better apprehended with reference to the following description and claims. The accompanying drawings, which constitute an integral part of this application, illustrate embodiments of the invention and which, together with the description, expound on the principles of the present invention.

To be clear, the highlighted embodiments of the present invention described in detail below are presented by way of example only and comprise less than a complete description of all of the variations and changes that may be possible without departing from the subject matter falling within the scope of the claims herein, and a reasonable equivalency thereof, which claims I regard as within the purview of my invention.

BRIEF DESCRIPTION OF THE DRAWINGS

One preferred form of the invention will now be described with reference to the accompanying drawings.

Two alternate embodiments of the invention will now be described with reference to the accompanying drawings

DRAWING—REFERENCE NUMBERS

Figure 1:
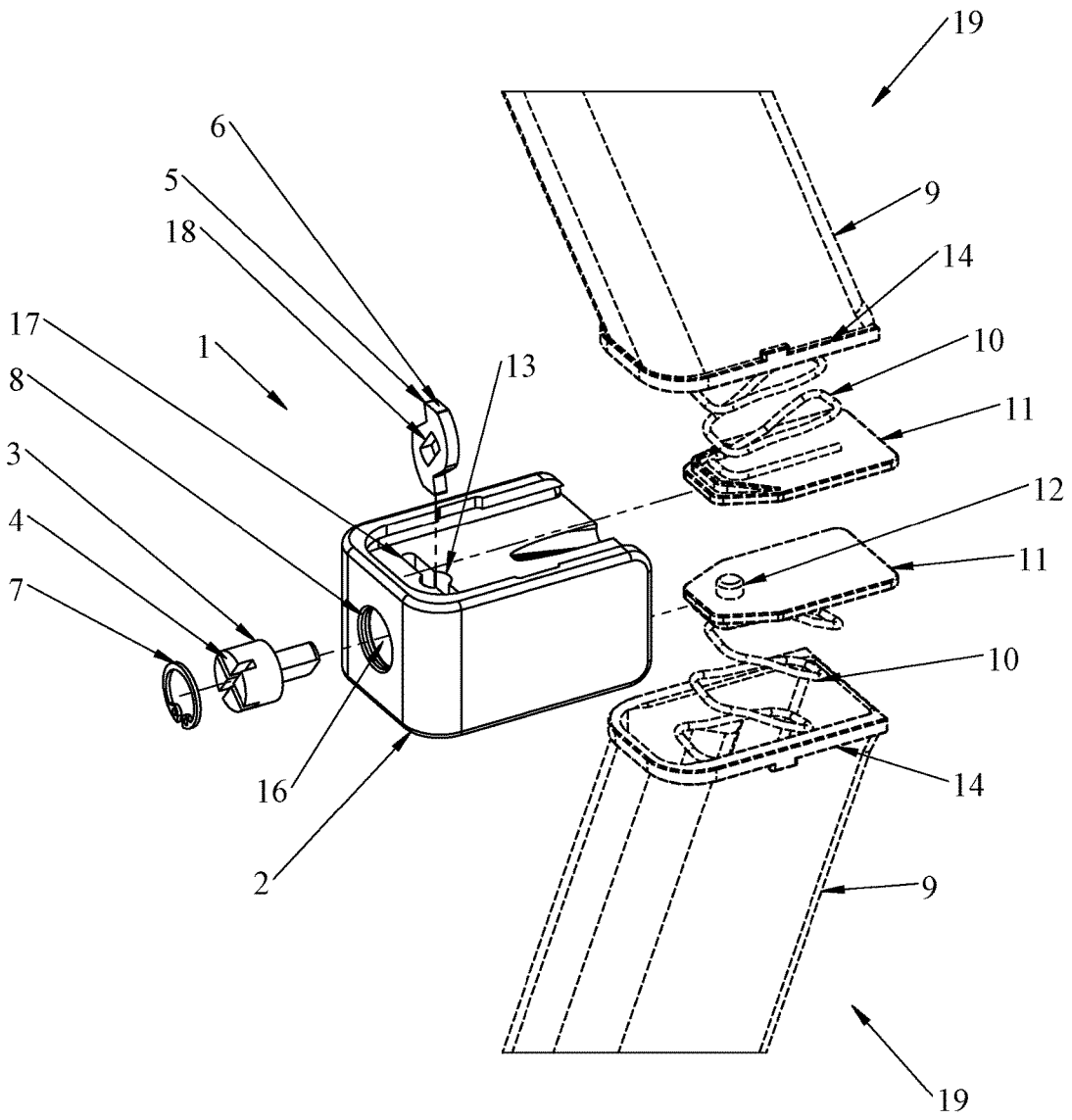
FIG. 1 illustrates an isometric exploded view of the present invention with magazines shown detached and exploded.

1. Present Invention
2. Main Body
3. Drive Shaft
4. Tool Face
5. Paddle
6. Contact Surface
7. Retaining Ring
8. Retaining Ring Slot
9. Magazine Body
10. Spring
11. Locking Plate
12. Locking Plate Boss
13. Locking Plate Boss Hole
14. Base Flange
15. Base Flange Slot
16. Shaft Hole
17. Paddle Slot
18. Drive Hole
19. Magazine Assembly
20. Release Direction
21. Unlocking Direction
22. Locking Direction
23. Forward Direction
24. Main Body B
25. Vertical Slot B
26. Circle Cut B
27. Locking Plate Boss Hole B
28. Tool B
29. Round Shaft B
30. Wedge Blade B
31. Angled Face B
32. Alternate Embodiment B
33. Alternate Embodiment C
34. Main Body C
35. S Shaped Slot C
36. Circular Cut C
37. Slot C
38. Locking Plate Boss Hole C
39. Tool C
40. S Shaped Tip C
41. Round Shaft C

DETAILED DESCRIPTION OF THE FIGURES

Preferred Embodiment

The present invention, which is the preferred embodiment, is described hereunder in detail with reference to the included drawings. Specific details are set forth in the description in order to provide a more complete understanding of the embodiments of the present invention. However, it will be apparent that specific embodiments may be incorporated, dis-incorporated or modified without affecting the purpose and function of the present invention. In addition, obvious or well-known process steps may not be described in detail in order to not unnecessarily obscure the present embodiment.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Since the firearm magazine is a well-known type, only those parts of the magazine assembly essential to the understanding of the present embodiment will be described in detail. The description of the present embodiment should be read with reference to the exemplary embodiments shown in the drawings. However, it must be understood that the present embodiment can be embodied in many alternate forms or embodiments. Further, alternate suitable shapes, sizes, types of elements or materials could be used to accomplish the purpose of the present embodiment. Indeed, any magazine end plate that employs a rotating shaft or tool to activate a captured locking mechanism may accomplish the intended function of the present embodiment.

The present embodiment is a base plate assembly, capable of locking and releasing one or two magazines securely. The present embodiment's assembly replaces the base plate of a typical magazine assembly or assemblies. The present embodiment allows for two magazine assemblies to be attached together, with the unique ability of being detached easily with a tool.

The present embodiment 1 is a multiple magazine assembly 19 locking base plate, comprised of a main body 2, a drive shaft 3, a paddle 5 and an internal retaining ring 7. The paddle 5 is inserted in to the paddle slot 17 and then the drive shaft 3 is inserted in to the shaft hole 16 in the main body 2, where the drive shaft 3 passes through and is retained in the center of the paddle 5. The paddle 5 and drive shaft 3 are held in the main body 2 by the retaining ring 7, which expands in to the retaining ring slot 8. The main body 1 incorporates a paddle slot 17 and a locking plate boss hole 13, that cuts through main body 2 of the present embodiment 1.

To install multiple magazine assemblies 19 on to the present embodiment 1, one would slide the magazine bodies base flange 9,14 into the base flange slot 15 on both sides of the main body 2. With the magazine assemblies bodies 9, 14 being retained by the base flange slot 15 of the inventions main body 2, the drive shaft 3 can be turned with a tool, which will rotate the paddle 5 housed in the paddle slot 17 of the present embodiment 1 until the contacting surface 6 is at its lowest point form the center of rotation, allowing the locking plate's boss's 12, of the magazine's assembly's 19, to be forced down by the magazine assemblies spring 19,10, in to the locking plate boss holes 13 of the main body 1, thereby locking the magazines 19 onto the present embodiment 1.

With the present embodiment 1 attached to magazine assemblies 19, the magazine assemblies 19 can be unlocked and the present embodiment 1 removed by means of a common tool such as a Philips or flat head screwdriver. When the screwdriver is inserted in to the tool face 4, one applies rotational force to the tool, which turns the drive shaft 3 and paddle 5. The paddle contact surface 5,6 moves along the locking plate boss 12 until the locking plate boss 12 is lifted out of the locking plate boss hole 13, at such time one can now slide the magazine 19 out of the base flange slot 15 until the magazine 19 is completely detached from the present embodiment 1.

FIG. 1

Referring now to the present embodiment 1 in more detail, in FIG. 1, there is shown the present embodiment 1 in an exploded state. There is also shown two magazine assemblies 19 detached from the present embodiment 1 and in an exploded state. The present embodiment 1 consists of a main body 2 with key features consisting of a shaft hole 16, a retaining ring slot 8, a paddle slot 17, a locking plate boss hole 13 and a magazine base flange slot 15. The present embodiment 1 is also comprised of a retaining ring 7, a drive shaft 3 with a tool face 4, and a paddle 5 with a contact surface 6 and drive hole 18.

The magazine assemblies 19 shown are of a common and well-known type. While all components of a magazine assembly 19 are not shown, the components relevant to the function of the present embodiment 1 are shown. Indeed, it is contemplated that the theory behind this invention could be applied to other types of magazines for multiple types of firearms, and even three- and four-magazine versions of the invention are contemplated. Turing to a preferred embodiment of the invention, these components are; the magazine body 9, a spring 10 and a locking plate 11. A typical magazine assembly 19 contains a spring 10 and a locking plate 11 contained within a magazine body 9 as well as other parts. The spring 11 pushes its tension downward on to the locking plate 11. The locking plate 11 has a locking plate boss 12 that falls in to a locking plate boss hole 13 similar to the hole on the main body 2 of the present embodiment, which then fixes the magazine body 9 and its contents to the main body 2.

The present embodiment 1 is assembled by inserting the paddle 5 in to the paddle slot 17. The paddle slot 17 is wide enough to allow for the paddle 5 to rotate in the paddle slot 17 without obstruction, and thin enough to have a close fit to the paddles 5 thickness. The drive shaft 3 is then inserted in to the shaft hole 16 and comes to rest in the drive hole 18 of the paddle 5, thus retaining the paddle 5 in the paddle slot 17. The drive shaft 3 is retained in the shaft hole 16 by the retaining ring 7 that is installed in the retaining ring slot 8.

FIG. 2

Figure 2:
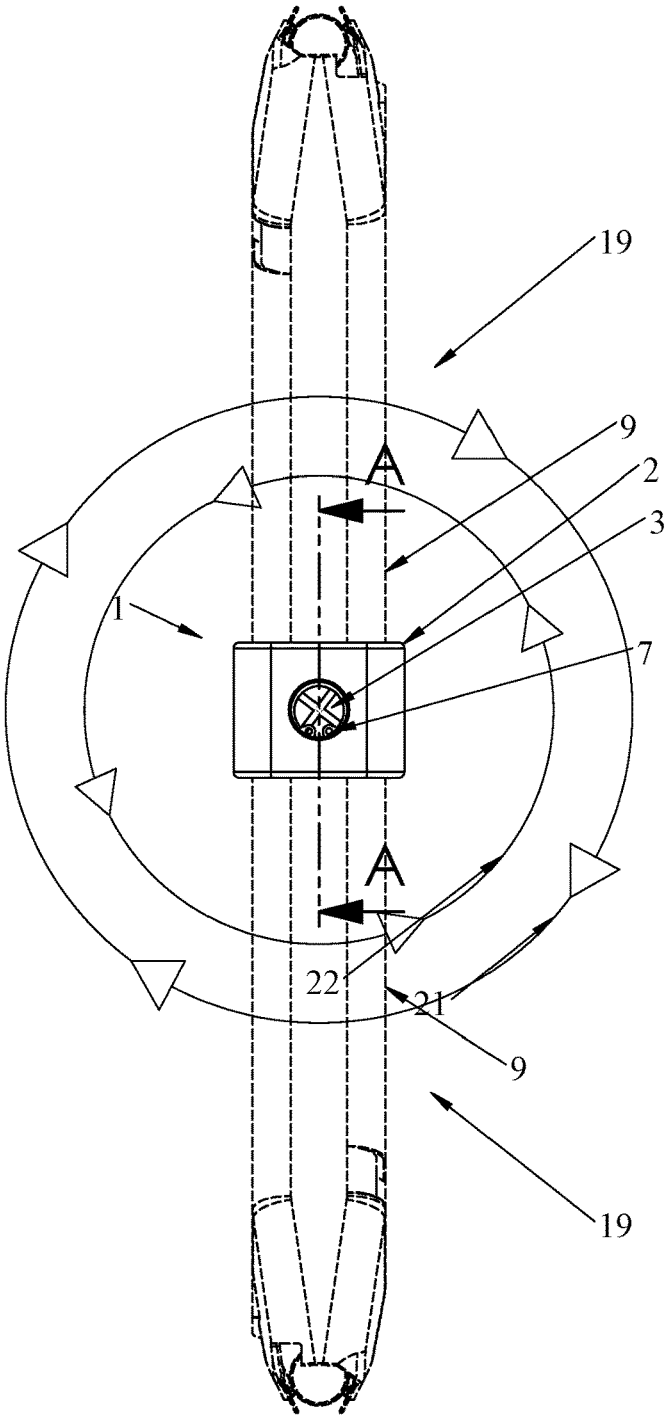
FIG. 2 illustrates a front view of the present invention with magazines attached.

Referring now to the present embodiment 1 in more detail, in FIG. 2, there is shown a front view of the present embodiment 1, with two magazine assemblies 19 installed. There is shown section line A cutting through the vertical mid plane of the present embodiment 1 and magazine assemblies 19. When a tool is inserted in the tool face 4, and rotational force is applied in an unlocking direction 21 the drive shaft 3 will turn the paddle 5 and the paddles contact surface 5, 6 will force the locking plate boss 12 and locking plate 11 up and away from the center of the assembly, thus freeing the magazine assembly 19, so that the magazine assembly 19 could be removed. One could apply rotational force in the locking direction 22 and return the paddle 5 in to a neutral state, which allows for a locking plate 11 to become fixed by means of the locking plate boss 12 falling in to the locking plate boss hole 13.

FIG. 3

Figure 3:
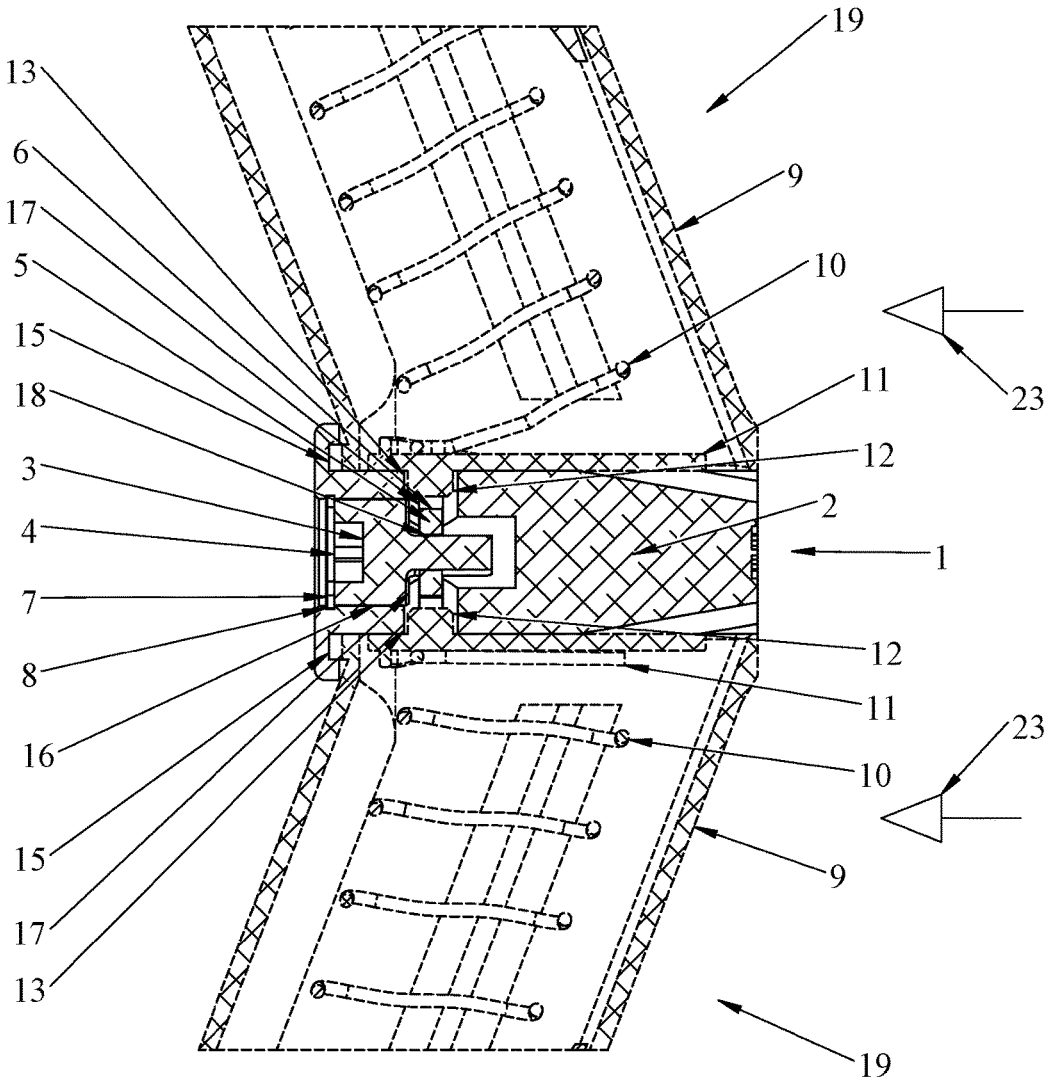
FIG. 3 illustrates section view A of the present invention with magazines attached and the paddle in a neutral and locked position.

Referring now to the present embodiment 1 in more detail, in FIG. 3, there is shown section view A of the present embodiment 1 with two magazine assemblies 19 attached and the paddle 5 in a neutral and locked position. The magazines were installed by aligning the magazine assemblies base flange 19, 14 in to the main body base flange slot 2,15 and sliding the magazine assembly 19 in the forward direction 23. There is shown a magazines bodys base flange 9, 14 fully inserted in to the magazine base flange slot 15, the locking plate boss 12 is align with the locking plate boss hole 13 and is retained in the locking plate boss hole 13 by means of the magazine assembly spring 19, 10. The pressure from the spring 10 keeps the locking plate 11 fixed, which in turn fixes the magazine assembly 19 to the main body 2. The paddle 5 is shown oriented in such a way that the lowest point of the contact surface 6 from the center of the paddle 5 are oriented vertically, allowing the locking plate boss 12 to fully insert in to the locking plate boss hole 13, which prevents the magazine assembly 19 from being removed from the present embodiment.

FIG. 4

Figure 4:
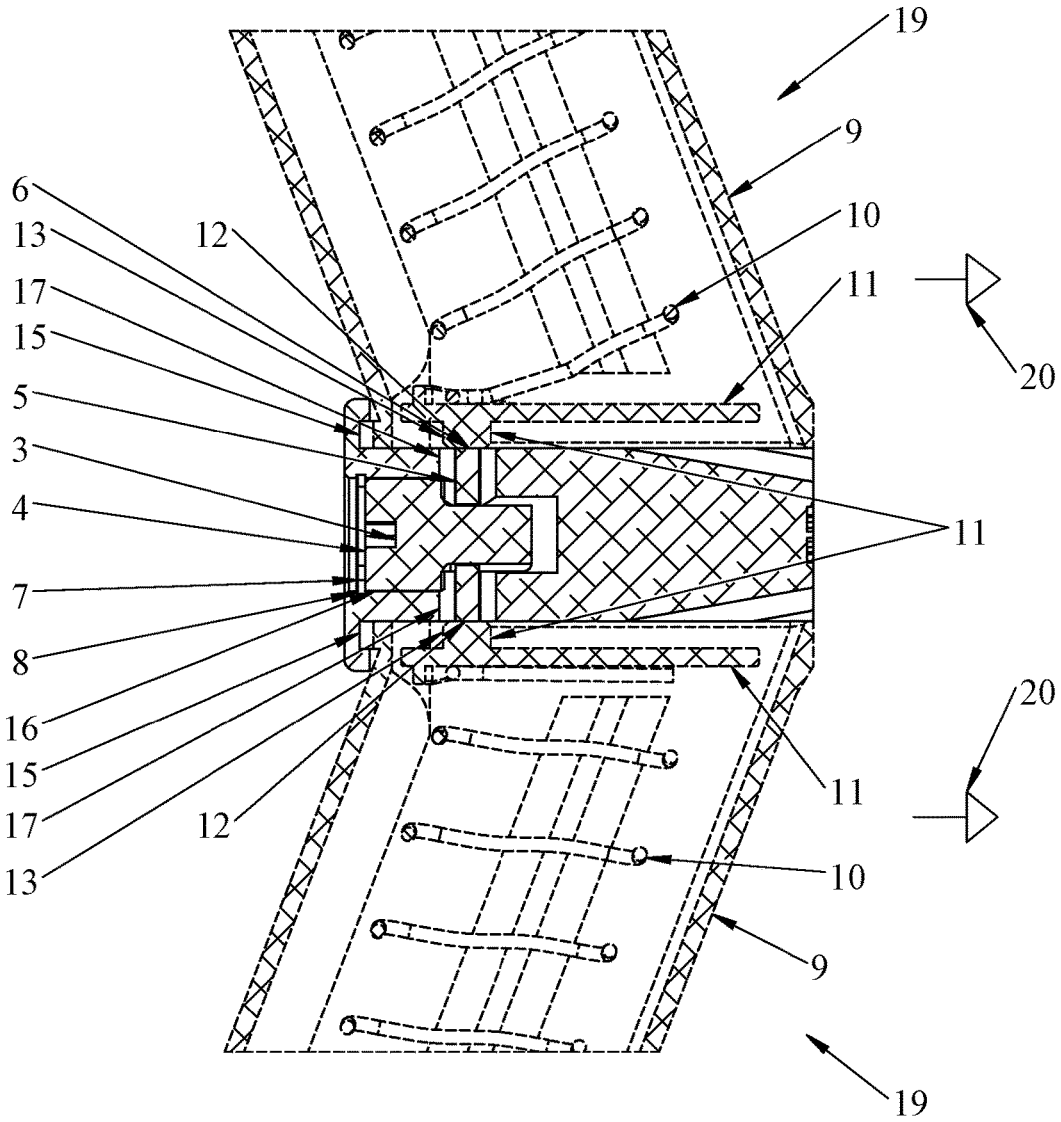
FIG. 4 illustrates section view A of the present invention with magazines attached and the paddle in an unlocked position.

Referring now to the present embodiment 1 in more detail, in FIG. 4, there is shown section view A of the present embodiment 1 with two magazine assemblies 19 attached and the paddle 5 in an unlocked position. There is shown magazines body base flanges 9, 14 fully engaged with the man body base flange slot 2, 15. When the paddle 5 is turned, by inserting a tool in the tool face 4 of the drive shaft 3 and rotating the drive shaft 3 such that the paddle 5 is oriented in such a way that the tallest point form the center of the paddle 5 and the contact surface 6 is oriented vertically, the contact surface 6 contacts and pushes the locking plate boss 12 forcing it away from the center of the present embodiments 1 assembly. This frees the locking plate 11. In the shown position of the paddle 5, which holds the locking plate boss 12 from the locking plate boss hole 13, thereby allowing the magazine assembly 19 to be removed from the magazine base flange slot 15 by pushing it in the release direction 20, freeing the magazine assembly 19 form the present embodiment 1.

Alternate Embodiment 1

FIG. 5

Figure 5:
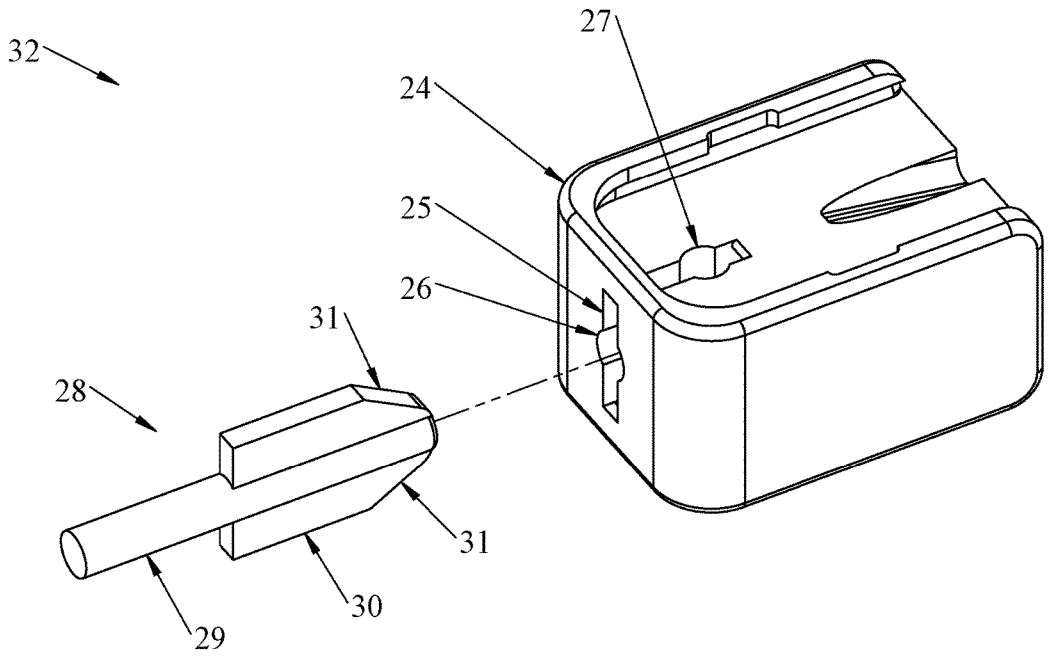
FIG. 5 illustrates alternate embodiment b of the present invention in which wedges "push up" against the locking plate boss hole.

Referring now to the alternate embodiment b 32 in more detail, in FIG. 5, there is shown the main body b 24 having a vertical slot b 25 and with a circle cut b 26 in the center front of the main body b 24. There is a locking plate boss hole b 27 passing from top to bottom of the assembly. A tool b 28 with a round shaft b 29 and a wedge blade b 30 which would be inserted in to the front of the main body b vertical slot b 24, 25, and as the angled faces b 31 of the wedge blade 30 are inserted they would lift, or push up, a locking plate boss 12 away from the center of the main body b 24 and release any attached magazines assemblies 19.

Alternate Embodiment 2

FIG. 6

Figure 6:
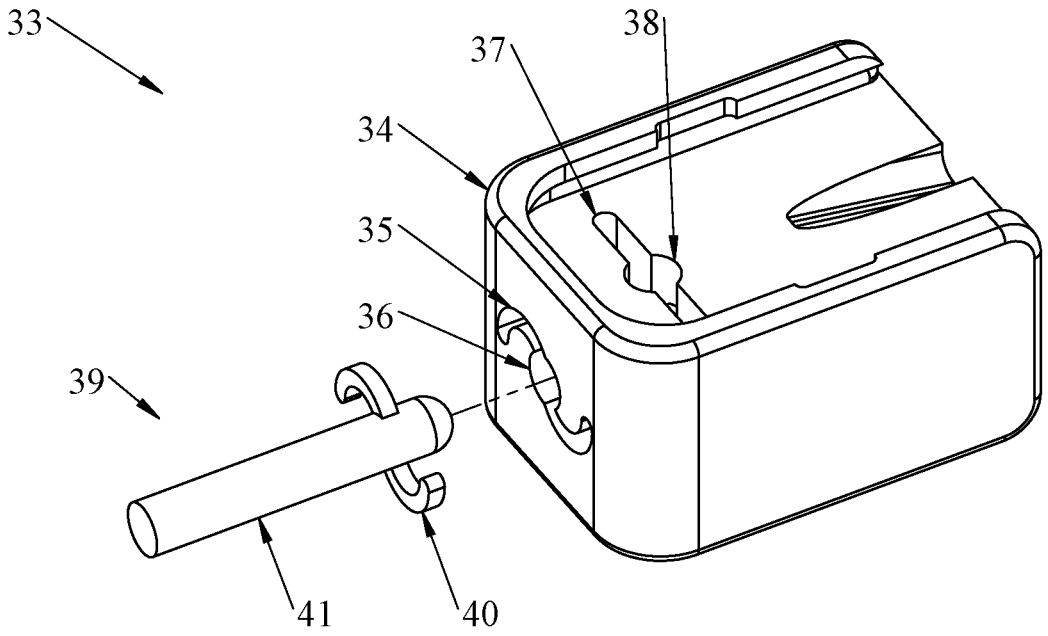
FIG. 6 illustrates alternate embodiment c of the present invention in which the paddle and the shaft are combined into a "twisting key" that can be inserted into the paddle slot, then twisted, to "pop up" the locking plate boss hole.

Referring now to the alternate embodiment c 33 in more detail, in FIG. 6, there is shown a main body c 34 having a s shaped slot c 35 at the front of the main body c 34, with a circular cut c 36 in the middle, and a slot c 37 and locking plate boss hole c 38 cutting through from top to bottom. A tool c 39 with a s shaped tip c 40 is and a round shaft c 41 is inserted in to the s shaped slot c 35 from the front of the main body c 34, then rotated about its center axis until the tool c's 39 s shaped tip c 40 makes contact the locking plate boss 12, lifting it up and out of the locking plate boss hole c 38, allowing one to release any fixed magazine assemblies 19. This embodiment basically takes the drive shaft and paddle as illustrated in FIG. 1, and combines them into a "twisting key" that can be inserted into the drive shaft, then rotated to either lock or unlock the magazines from the invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved. While the foregoing written description of the embodiment enables one of ordinary skill to make and use what is considered presently to be the best mode thereof, those of ordinary skill will understand and appreciate the existence of variations, combinations, and equivalents of the specific embodiment, method, and examples herein. Therefore, the embodiment should not be limited by the above described embodiment, method and examples, but by all embodiments and methods within the scope and spirit of the embodiment.

Advantages

Advantages of the present embodiment include, but are not limited to, the ability to connect two magazines together in a way that also allows for their separation.

Recreational rifle users may also find that the present embodiment allows them to remain on the practice range for an extended period, improving their skill level.

The present embodiment is also advantages in home security, when an individual must protect themself or their property they will now have twice as much ammunition, and that ammunition will be more readily available by means of the present embodiment holding a second magazine below an already loaded magazine.

An additional advantage is that the present embodiment is easily installed and removed with a minimum of mechanical knowledge or experience, and without the requirement for specialized tools.

That which is claimed:

1. A device for removably attaching two or more magazine cartridges, consisting of a main body and a locking plate system, where the locking plate system comprises a locking plate, where the locking plate has a spring side and a boss side, a locking plate boss, and a spring, where the locking plate system fits into a magazine cartridge, where the spring attaches to the spring side of the locking plate, and the locking plate boss is located on the boss side of the locking plate, where locking plate system fits within a bottom of a magazine cartridge, where the magazine cartridge is a base flange, where the main body comprises a drive shaft, a shaft hole, a tool face, a paddle, a contact surface, a retaining ring, a retaining ring slot, a paddle slot, a drive hole, two locking plate boss holes, and two base flange slots, where the base flange of the magazine cartridge can be removably secured within a base flange slot of the main body, where the locking plate boss on the locking plate can be removably inserted into a locking plate boss hole on the main body, where the paddle slot houses a paddle, where the paddle has a contact surface and a drive hole, where the main body additionally comprises a shaft hole and a drive shaft, where the drive shaft can be inserted into the shaft hole, where the drive shaft has a drive shaft end that engages the drive hole in the paddle, where the drive shaft is retained within the shaft hole by a retaining ring, which, in turn, is retained in the retaining ring slot, which is located in the shaft hole, where the drive draft shaft additionally comprises a tool face, such that two magazine cartridges can be slid into the two base flange slots, such that the base flange of each of the magazine cartridges is retained within a base flange slot, and the boss of each locking plate can be inserted into the locking plate boss hole, and where the drive shaft can be turned with a tool to rotate the paddle housed in the paddle slot until the contacting surface of the paddle is at a lowest point from the center of rotation, allowing the boss to be forced down by the spring in to the locking plate boss hole of the main body, thereby locking the magazine cartridge into the main body, and where the boss can be "unlocked" by turning the tool face of the drive shaft such that the boss is lifted out of the locking place boss hole, thereby allowing a user to slide the magazine cartridge out of the base flange slot, where the tool face has two slots, where the two slots are perpendicular to each other, such that the tool face can be rotated both a flathead and Phillips screwdriver.

2. A device for removably attaching two or more magazine cartridges, comprising a main body and a locking plate system, where the locking plate system comprises a locking plate, where the main body comprises, two locking plate boss holes, and two base flange slots, where a base flange of one of the two or more magazine cartridges can be removably secured within a base flange slot of the main body, where the locking plate has a spring side and a boss side, a locking plate boss, and a spring, where the locking plate system fits into a magazine cartridge, where the spring attaches to the spring side of the locking plate, and the locking plate boss is located on the boss side of the locking plate, where locking plate system fits within a bottom of a magazine cartridge, where the magazine cartridge has a base flange, and where the main body additionally comprises a drive shaft, and a shaft hole.

3. The device of claim 2, where the main body additionally comprises a tool face, a paddle, a contact surface, a retaining ring, a retaining ring slot, a paddle slot, and a drive hole.

4. The device of claim 3, where the locking plate boss on the locking plate can be removably inserted into a locking plate boss hole on the main body.

5. The device of claim 4, where the paddle slot houses a paddle, where the paddle has a contact surface and a drive hole, where the main body additionally comprises a shaft hole and a drive shaft.

6. The device of claim 5, where the drive shaft can be inserted into the shaft hole, where the drive shaft has a drive shaft end that engages the drive hole in the paddle, where the drive shaft is retained within the shaft hole by a retaining ring, which, in turn, is retained in the retaining ring slot, which is located in the shaft hole, where the draft shaft additionally comprises a tool face, such that two magazine cartridges can be slid into the two base flange slots, such that the base flange of each of the magazine cartridges is retained within a base flange slot, and the boss of each locking plate can be inserted into the locking plate boss hole, and where the drive shaft can be turned with a tool to rotate the paddle housed in the paddle slot until the contacting surface of the paddle is at a lowest point from the center of rotation, allowing the boss to be forced down by the spring in to the locking plate boss hole of the main body, thereby locking the magazine cartridge into the main body, and where the boss can be "unlocked" by turning the tool face of the drive shaft such that the boss is lifted out of the locking place boss hole, thereby allowing a user to slide the magazine cartridge out of the base flange slot.

7. The device of claim 5, where the drive shaft additionally comprises a key end, and where the drive hole additionally comprises a key end receptacle, where the key end has a key end shape, and where the key receptacle has a key receptacle cavity, where the key receptacle cavity has a key receptacle cavity shape, and where the key shape is similar to the key end receptacle cavity shape, such that only a drive shaft with a particularly key shape will fit into the key receptacle cavity of a particular main body, such that only a user with a particular key shape can operate the paddle of a particular main body.

8. A device for removably attaching two or more magazine cartridges to a pistol or other firearm, comprising a main body and a locking plate system, where the locking plate system comprises a locking plate, where the main body comprises, two locking plate boss holes, and two base flange slots, where the base flange of the magazine cartridge can be removably secured within a base flange slot of the main body, where the main body additionally comprises a drive shaft, and a shaft hole.

9. The device of claim 8, where the locking plate has a spring side and a boss side, a locking plate boss, and a spring, where the locking plate system fits into a magazine cartridge, where the spring attaches to the spring side of the locking plate, and the locking plate boss is located on the boss side of the locking plate, where locking plate system fits within a bottom of a magazine cartridge, where the magazine cartridge is a base flange.

10. The device of claim 8, where the main body additionally comprises a tool face, a paddle, a contact surface, a retaining ring, a retaining ring slot, a paddle slot, and a drive hole.

11. The device of claim 8, where the locking plate has a spring side and a boss side, a locking plate boss, and a spring.

12. The device of claim 8, where the locking plate has a spring side and a boss side, a locking plate boss, and a spring, where the locking plate system fits into a magazine cartridge, where the spring attaches to the spring side of the locking plate, and the locking plate boss is located on the boss side of the locking plate, where locking plate system fits within a bottom of a magazine cartridge, where the magazine cartridge is a base flange and where the locking plate boss on the locking plate can be removably inserted into a locking plate boss hole on the main body.

13. The device of claim 8, where the paddle slot houses a paddle, where the paddle has a contact surface and a drive hole, where the main body additionally comprises a shaft hole and a drive shaft.

14. The device of claim 13, where the drive shaft additionally comprises a key end, and where the drive hole additionally comprises a key end receptacle, where the key end has a key end shape, and where the key receptacle has a key receptacle cavity, where the key receptacle cavity has a key receptacle cavity shape, and where the key shape is similar to the key end receptacle cavity shape, such that only a drive shaft with a particularly key shape will fit into the key receptacle cavity of a particular main body, such that only a user with a particular key shape can operate the paddle of a particular main body.

15. The device of claim 8, where the drive shaft can be inserted into the shaft hole, where the drive shaft has a drive shaft end that engages the drive hole in the paddle, where the drive shaft is retained within the shaft hole by a retaining ring, which, in turn, is retained in the retaining ring slot, which is located in the shaft hole, where the draft shaft additionally comprises a tool face, such that two magazine cartridges can be slid into the two base flange slots, such that the base flange of each of the magazine cartridges is retained within a base flange slot, and the boss of each locking plate can be inserted into the locking plate boss hole, and where the drive shaft can be turned with a tool to rotate the paddle housed in the paddle slot until the contacting surface of the paddle is at a lowest point from the center of rotation, allowing the boss to be forced down by the spring in to the locking plate boss hole of the main body, thereby locking the magazine cartridge into the main body, and where the boss can be "unlocked" by turning the tool face of the drive shaft such that the boss is lifted out of the locking place boss hole, thereby allowing a user to slide the magazine cartridge out of the base flange slot.

16. The device of claim 15, where the drive shaft additionally comprises a key end, and where the drive hole additionally comprises a key end receptacle, where the key end has a key end shape, and where the key receptacle has a key receptacle cavity, where the key receptacle cavity has a key receptacle cavity shape, and where the key shape is similar to the key end receptacle cavity shape, such that only a drive shaft with a particularly key shape will fit into the key receptacle cavity of a particular main body, such that only a user with a particular key shape can operate the paddle of a particular main body.

17. The device of claim 8, where the locking plate has a spring side and a boss side, a locking plate boss, and a spring and where the main body additionally comprises a tool face, a paddle, a contact surface, a retaining ring, a retaining ring slot, a paddle slot, and a drive hole.

18. The device of claim 17, where the locking plate system fits into a magazine cartridge, where the spring attaches to the spring side of the locking plate, and the locking plate boss is located on the boss side of the locking plate, where locking plate system fits within a bottom of a magazine cartridge, where the magazine cartridge is a base flange, where the drive shaft can be inserted into the shaft hole, where the drive shaft has a drive shaft end that engages the drive hole in the paddle, where the drive shaft is retained within the shaft hole by a retaining ring, which, in turn, is retained in the retaining ring slot, which is located in the shaft hole, where the drive shaft additionally comprises a tool face.

* * * * *